US007832680B2

(12) United States Patent
Yokoyama

(10) Patent No.: US 7,832,680 B2
(45) Date of Patent: Nov. 16, 2010

(54) CONTINUOUS SHEET PROCESSING APPARATUS

(75) Inventor: Yasumi Yokoyama, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/229,806

(22) Filed: Aug. 27, 2008

(65) Prior Publication Data

US 2009/0085282 A1 Apr. 2, 2009

(30) Foreign Application Priority Data

Sep. 27, 2007 (JP) ..... 2007-251422

(51) Int. Cl.
*B65H 23/00* (2006.01)

(52) U.S. Cl. ..... 242/566

(58) Field of Classification Search ..... 242/595, 242/548, 566, 615, 615.2; 400/611, 613, 400/692, 693; 101/93, 225, 228
See application file for complete search history.

(56) References Cited

U.S. PATENT DOCUMENTS 5,033,881 A * 7/1991 Koike ..... 400/613
6,022,158 A * 2/2000 Nakayama et al. ..... 400/613
6,749,353 B1 * 6/2004 Favre et al. ..... 400/680
7,125,181 B2 * 10/2006 Takabatake et al. ..... 400/605
2004/0173706 A1 * 9/2004 Takagi et al. ..... 242/348
2006/0269348 A1 * 11/2006 Nagata ..... 400/615.2

FOREIGN PATENT DOCUMENTS

JP 04164764 A * 6/1992

* cited by examiner

*Primary Examiner*—William A Rivera
(74) *Attorney, Agent, or Firm*—Adams & Wilks

(57) ABSTRACT

A continuous sheet processing apparatus has a main body portion that accommodates a roll formed of a wound continuous sheet, a door portion movable to opened and closed positions for opening and closing an inlet of the main body portion through which the roll is introduced into the accommodating portion, and a processing portion that processes the continuous sheet drawn out from the roll. A guide portion is movable between a first position in which the guide portion extends parallel to the center axis of the roll and guides the path of the drawn-out continuous sheet so that the drawing-out angle thereof is an acute angle, and a second position in which the guide portion extends transverse to the center axis of the roll. A guide portion actuator moves the guide portion to the first position in conjunction with movement of the door portion to the closed position and moves the guide portion to the second position in conjunction with movement of the door portion to the open position.

13 Claims, 5 Drawing Sheets

CONTINUOUS SHEET PROCESSING APPARATUS

BACKGROUND OF THE INVENTION

1. Field of the Invention

The present invention relates to a continuous sheet processing apparatus in which printing, thermal activation, and the like are performed on a continuous sheet.

2. Description of the Related Art

Conventionally, a continuous sheet processing apparatus is well-known in which a continuous sheet is sequentially sent forth from a roll body, the sent-forth continuous sheet is subject to printing, thermal activation, and the like, and a processed portion is cut to provide single-cut sheets.

Examples of the continuous sheet processing apparatus include, as disclosed in Patent Document JP 2004-306561 A, one of a so-called throw-in type which merely accommodates a roll body without supporting a core of the roll body. The continuous sheet processing apparatus includes a roll body accommodating chamber in a main body portion thereof, and a roll body inlet formed in the front surface of the main body portion. Further, the above-mentioned front surface of the main body portion is provided with a door portion for opening and closing the roll body inlet. Further, a thermal head for performing thermal printing on a continuous sheet, and a platen roller for sending forth the continuous sheet are arranged at the portion on the front surface side, that is, the upper portion of the roll body accommodating chamber. The thermal head is fixed to the main body portion, and the platen roller is fixed to the upper portion of the door portion. Those thermal head and platen roller are arranged vertically close to each other in the state where the door portion is closed, and the continuous sheet drawn out of the tail end side of the roll body is caught therebetween. In the case of replacing the roller body in the continuous sheet processing apparatus having the above-mentioned structure, it is only necessary to open the door portion, throw-in the roll body from the roll body inlet for placing the roll body in the roll body accommodating chamber, and close the door portion after causing the continuous sheet drawn out of the roll body to be caught between the thermal head and the platen roller.

Further, the continuous sheet processing apparatus of the throw-in type described above includes a guide portion for holding the drawn-out portion of the continuous sheet drawn out of the roll body from the front side thereof. The guide portion is structured so as to be provided therewith while protruding to the inner surface of the door portion, and holds the drawn-out portion of the continuous sheet by closing the door portion. With this structure, the drawing-out angle of the continuous sheet from the roll body is made acute, whereby it is possible to prevent the lifting-up of the roll body at the time of drawing-out of the continuous sheet.

However, in the conventional continuous sheet processing apparatus described above, the guide portion is provided while protruding in the inner surface of the door portion. Thus, there is a problem in that the roll body is difficult to throw-in because the guide portion presents as an obstruct in opening the door portion for throwing-in the roll body.

Further, in view of the above-mentioned problem, a solving means may be implemented in which a link mechanism for turning the guide portion in accordance with the opening and closing of the door portion is provided to the door portion, the guide portion being folded simultaneously with the opening of the door portion, and being risen simultaneously with the closing of the door portion. However, the following problem is expected: the link mechanism provided to the door portion is positioned while allowing to be touched by a user at the time of replacing the roll body, thereby involving defects (deformation and the like) of the link mechanism caused by the user. When the defects occur in the link mechanism, the guide portion is not turned, so the drawn-out portion of the continuous sheet cannot be held in some cases.

SUMMARY OF THE INVENTION

The present invention has been made in view of the above-mentioned conventional problems, and an object of the present invention is to provide a continuous sheet processing apparatus in which the lifting-up of the roll body can be prevented, the roll body can be easily thrown-in, the defects are less liable to be caused, and the drawing-out angle of the continuous sheet can be reliably made acute.

A continuous sheet processing apparatus according to the present invention is provided with:

a main body portion including:

a roll body accommodating chamber for accommodating a roll body formed by being wound a continuous sheet thereabout; and a roll body inlet for throwing the roll body in the roll body accommodating chamber;

a door portion for opening and closing the roll body inlet;

a guide portion disposed on one side with respect to a center reference line orthogonal to a center axis line of the roll body accommodated in the roll body accommodating chamber, for holding from another side a drawn-out portion drawn out of a portion on the one side with respect to the center reference line of the roll body; and a processing portion disposed on the another side with respect to the center reference line, for processing the continuous sheet sent forth via the guide portion, the continuous sheet processing apparatus being characterized in that:

the continuous sheet processing apparatus comprises a guide portion moving means for moving the guide portion between a first position at which the guide portion holds the drawn-out portion from the other side and a second position at which the guide portion is led out of a space between the drawn-out portion and the roll body; and the guide portion and the guide portion moving means are arranged in the roll body accommodating chamber.

With the characteristics as described above, when the roll body is replaced, the door portion is opened first so as to open the roll body inlet, and the guide portion is moved by the guide portion moving means to the second position so as to be led out to the position where the guide portion does not interfere the continuous sheet (roll body). Next, the roll body is thrown into the roll body accommodating chamber via the roll body inlet. In this case, the roll body is thrown thereinto while directed such that the continuous sheet is drawn out from the one side (opposite side to the processing portion) with respect to the center reference line. Subsequently, the door portion is closed, so the guide portion is moved by the guide portion moving means to the first position, thereby holding the drawn-out portion of the continuous sheet. As a result, the drawing-out angle of the continuous sheet from the roll body is made acute. Through the above-mentioned process, the replacement of the roll body is completed.

Further, in the continuous sheet processing apparatus according to the present invention, it is preferable that:

the guide portion moving means be a means which is activated in accordance with an opening operation and a closing operation of the door portion;

the guide portion be moved to the second position in conjunction with the opening operation of the door portion; and the guide portion be moved to the first position in conjunction with the closing operation of the door portion.

As a result, simultaneously with the opening of the door portion, the guide portion is moved so as to be disposed at the second position, and is led out of the space between the roll body and the drawn-out portion of the continuous sheet. Meanwhile, simultaneously with the closing of the door portion, the guide portion is moved so as to be disposed at the first position, whereby the drawn-out portion of the continuous sheet is held from the other side.

Further, in the continuous sheet processing apparatus according to the present invention, it is preferable that:

the guide portion moving means include:

a slider which is slidably provided along a wall surface of the roll body accommodating chamber facing an end surface of the roll body, and which slides while pressed by a pressing portion provided to the door portion in conjunction with the closing operation of the door portion; and a biasing member for biasing the slider slid by the pressing portion in a direction in which the slider is returned to an initial position;

the guide portion be rotatably provided to the slider along a virtual plane orthogonal to the wall surface while extending in a sliding direction of the slider;

a rotational axis portion of the guide portion has an engaging portion protruding therefrom, which extends in a direction in which the engaging portion intersects with a center axis line of the guide portion;

in a state before the pressure portion allows the slider to slide, the engaging portion be inserted into a hole portion formed in the wall surface so as to dispose the guide portion at the second position along the wall surface; and in a state after the pressure portion allows the slider to slide, the engaging portion be disengaged from the hole portion to come into sliding contact with the wall surface so as to dispose the guide portion at the first position while the guide portion protrudes from the wall side surface.

As a result, when the door portion is opened, the pressing portion moves together with the door portion, so the pressing force by the pressing portion to the slider is cancelled. As a result, the slider is slid by the bias from the biasing member, and the engaging portion is inserted into the hole portion formed in the wall surface, so the guide portion is turned to be disposed along the wall surface, thereby being disposed at the second position. Meanwhile, when the door portion is closed, the pressing portion moves together with the door portion so as to press the slider. As a result, the slider is slid, and the engaging portion is disengaged from the hole portion to come into sliding contact with the wall surface, so the guide portion is turned to protrude from the wall surface, thereby being disposed at the first position.

Further, in the continuous sheet processing apparatus according to the present invention, it is preferable that an end surface of the hole portion on an opposite side of the roll body inlet side form an inclined surface so that a depth of the hole portion gradually decreases toward the opposite side.

As a result, since the engaging portion slides on the inclined surface of the hole portion end surface so as to turn the guide portion along with the sliding of the slider, the impact (load) generated in disengaging the engaging portion from the hole portion is alleviated, so the guide portion is smoothly turned.

Further, in the continuous sheet processing apparatus according to the present invention, it is preferable that, in a state where the pressure portion has not slid the slider, the engaging portion be fitted to the end surface on the roll body inlet side of the hole portion.

As a result, the door portion is opened, and the pressing force by the pressing portion to the slider is cancelled. When the slider is slid by the biasing of the biasing member, the slider stops at the position where the engaging portion comes into contact with the end surface on the roll body inlet side of the hole portion, thereby disposed at the predetermined position.

In the continuous sheet processing apparatus according to the present invention, since the drawn-out portion of the continuous sheet is held by the guide portion, the drawing-out angle of the continuous sheet is made acute. Thus, the lifting-up of the roll body can be prevented at the time of drawing-out of the continuous sheet. Further, since the guide portion is brought out, by the guide portion moving means, of the path on which the continuous sheet is sent forth, the guide portion does not present as an obstruct in throwing the roll body into the roll body accommodating chamber. As a result, the roll body can be easily thrown-in, which leads to an increase in operability. Further, the guide portion and the guide portion moving means are provided in the roll body accommodating chamber, and positioned such that a user cannot easily touch the guide portion and the guide portion moving means. Thus, the defects are less liable to occur in the guide portion and the guide portion moving means, so the drawing-out angle of the continuous sheet can be reliably made acute.

DETAILED DESCRIPTION OF THE PREFERRED EMBODIMENT

Hereinafter, with reference to the drawings, an embodiment of the continuous sheet processing apparatus according to the present invention is described.

Figure 1:
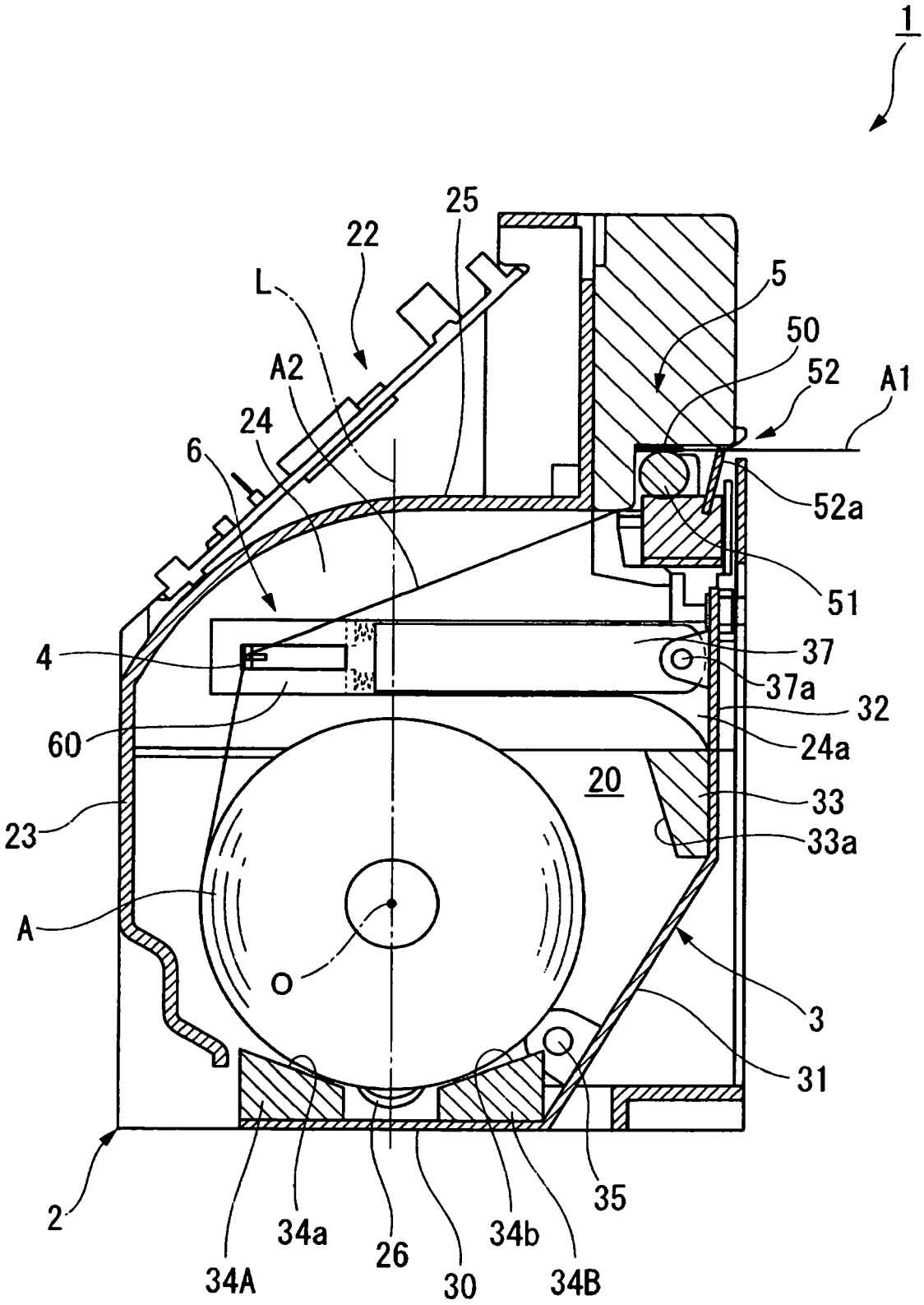
FIG. 1 is a sectional view of a continuous sheet processing apparatus in a state where a door portion is closed for describing an embodiment of the present invention.
Figure 2:
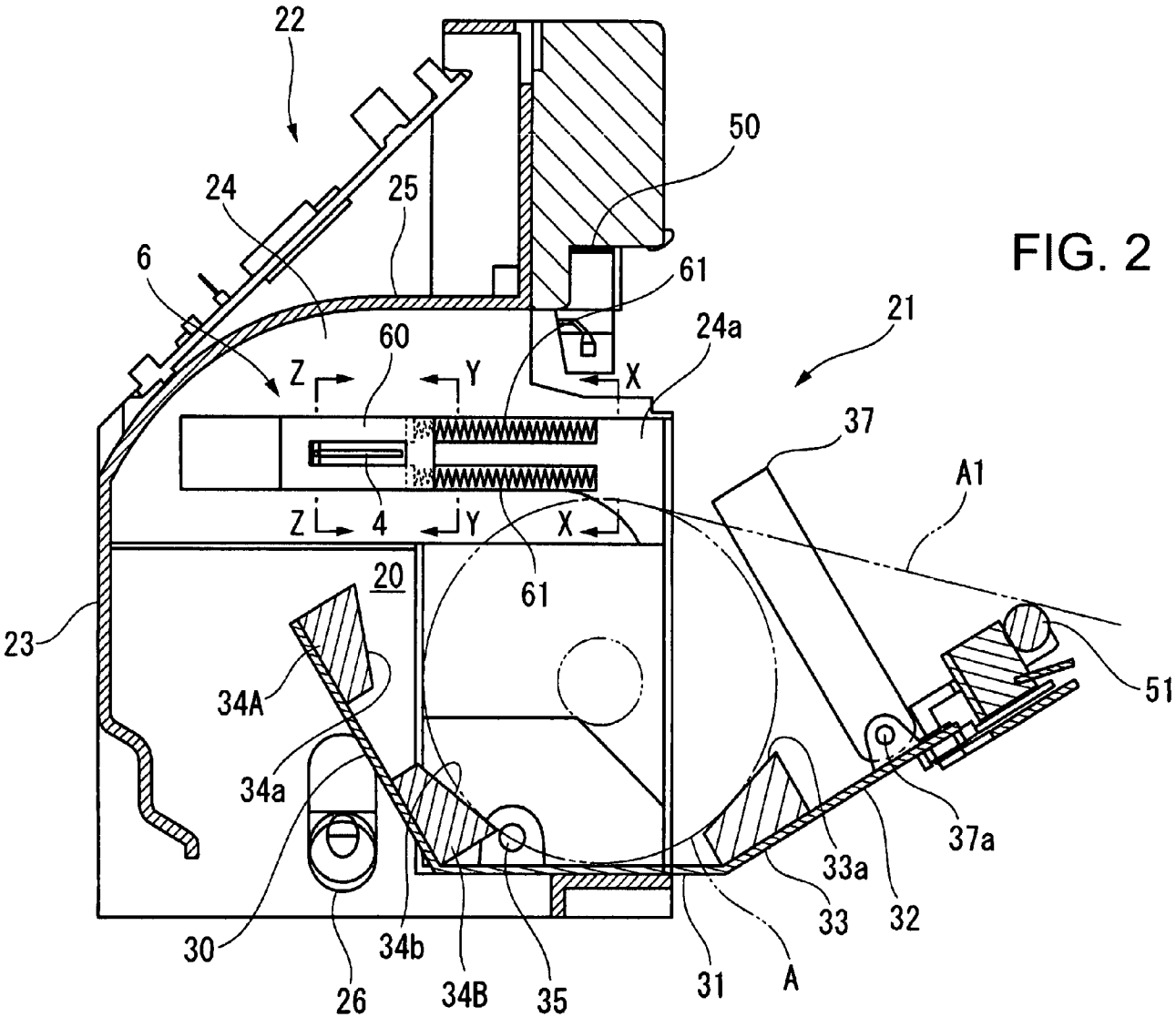
FIG. 2 is a sectional view of the continuous sheet processing apparatus in a state where the door portion is opened for describing the embodiment of the present invention.

FIG. 1 is a sectional view of a continuous sheet processing apparatus 1 in the state where a door portion 3 described later is closed, and FIG. 2 is a sectional view of the continuous sheet processing apparatus 1 in the state where the door portion 3 described later is opened. Note that, in the embodiment of the present invention, it is assumed that the left side of FIGS. 1 and 2 is rear (corresponding to one side of the present invention), the right side of FIGS. 1 and 2 is front (corresponding to the other side of the present invention), and the longitudinal direction of FIGS. 1 and 2 is the vertical direction. Further, a chain line L extending in the vertical direction illustrated in FIG. 1 is a virtual line illustrating a center reference line orthogonal to a center axis line O of a roll body A described later. The center reference line L passes through the substantially central position in the fore-and-aft direction of a main body portion 2 described later.

As illustrated in FIGS. 1 and 2, the continuous sheet processing apparatus 1 is an apparatus for performing processing on a continuous sheet A1, and schematically includes the main body portion 2, the door portion 3, a guide portion 4, a processing portion 5, and a guide portion moving means 6 which constitutes a guide portion actuator.

In the main body portion 2, a roll body accommodating chamber 20 is formed for accommodating the roll body A formed by being wound the continuous sheet A1 thereabout, and on the front surface side of the main body portion 2, a roll body inlet 21 is formed for throwing the roll body A in the roll body accommodating chamber 20. Further, on the upper surface on the rear side of the main body portion 2, there is provided a control substrate 22 for controlling, while electrically connected to an operation panel (not shown), the continuous sheet processing apparatus 1. The roll body accommodating chamber 20 is a space defined by being surrounded by a rear wall 23 of the main body portion 2, a side wall 24 on each of both sides, an upper wall 25, and the door portion 3. Note that, the inner surface of the side wall 24 correspond to the wall surface of the present invention. In the roll body accommodating chamber 20, a sensor 26 is provided for detecting the residual amount of the roll body A. The roll body inlet 21 is formed at an interval between the side wall 24 oppositely disposed each on both the sides, the width dimension of the roll body inlet 21 is larger than the length in the axial direction of the roll body A.

The door portion 3 opens and closes the roll body inlet 21, and is rotatably (rockably) provided to the main body portion 2. In a detailed description, the door portion 3 includes a bottom plate portion 30 for blocking the bottom surface of the roll body accommodating chamber 20, an inclined plate portion 31 for blocking, while provided at the front end of the bottom plate portion 30 so as to stand while inclined forward, the lower portion on the front surface of the roll body accommodating chamber 20, a longitudinal plate portion 32 for blocking, while provided vertically upward at the upper end of the inclined plate portion 31, the upper portion on the front surface of the roll body accommodating chamber 20.

On the upper surface (inner surface) of the bottom plate portion 30, a pair of pedestals 34A and 34B are provided for supporting the roll body A. The pair of pedestals 34A and 34B are arranged in the fore-and-aft direction. The upper surface of the pedestal 34A on the rear side forms an inclined surface 34*a* inclined downward from the rear side to the front side in the state where the door portion 3 is closed. Further, the pedestal 34B on the front side forms an inclined surface 34*b* inclined downward from the front side to the rear side in the state where the door portion 3 is closed. That is, the pair of pedestals 34A and 34B form an inverted shape of ^ (substantially V-shape).

On both the side ends of the inclined plate portion 31, a rotational axis portion 35 of the door portion 3 is provided. The rotational portion axis 35 defines an axis extending in the horizontal direction (direction parallel to the axis line of roll body A), and is supported by the side wall 24 of the main body portion 2. The door portion 3 is rockable about the rotational axis portion 35.

On the inner surface (rear side surface) of the longitudinal plate portion 32, a temporal pedestal 33 is provided for temporarily placing the roll body A in throwing-in the roll body A. The front end surface of the temporal pedestal 33 forms an inclined surface 33*a* inclined frontward from the upper side to the lower side in the state where the door portion 3 is closed. In the state where the door portion 3 is opened, the upper surface (inclined surface 34*b*) of the pedestal 34B on the front side and the upper surface (inclined surface 33*a*) of the temporal pedestal 33 form a substantially V-shape.

Further, a pressing portion 37 which exerts a trigger function for activating the guide portion moving means 6 is provided to the door portion 3. In a detailed description, the pressing portion 37 is constituted by a substantially square plate member protruding from the inner surface of the longitudinal plate portion 32. A rotational axis 37*a* is provided to the base end portion of the pressing portion 37, the pressing portion 37 being rotatably provided along the virtual vertical surface extending in the fore-and-aft direction. Further, the pressing portion 37 is provided with an elastic member (not shown) such as a torsion spring. When the force acting on the pressing portion 37 is cancelled by the elastic force of the elastic member, the pressing portion 37 is returned to the position at which the pressing portion 37 protrudes in a substantially vertical direction with respect to the longitudinal plate portion 32.

The processing portion 5 is arranged diagonally frontward above the roll body accommodating chamber 20, and arranged on the front side with respect to the center reference line L. The processing portion 5 includes a processing head 50 positioned, while fixed to the front portion of the main body portion 2, above the roll body inlet 21, and a platen roller 51 positioned oppositely, while fixed to the upper portion of the door portion 3, to the processing head 50. The continuous sheet A1 processed by the continuous sheet processing apparatus 1 is caught between the processing head 50 and the platen roller 51. The platen roller 51 sequentially conveys the continuous sheet A1 by being rotatably driven by a driving means (not shown), the continuous sheet A1 being supported thereby while pressed with respect to the processing head 50. The processing head 50 performs processing on the continuous sheet A1 supported by the platen roller 51. Examples thereof include a recording head for performing recording on a continuous sheet having a recording surface or a thermal activation head for developing adhesion by heating a continuous sheet having an adhesive surface. On the downstream side (rear side) of the processing head 50 and the platen roller 51, there is provided a cutting means 52 for cutting the continuous sheet A1 after the processing by the processing head 50. The cutting means 52 is constituted, for example, by a movable blade (not shown) reciprocating in the vertical direction while provided to the main body portion 2, and a fixed blade 52*a* opposite to the movable blade while fixed to the upper portion of the door portion 3. When the movable blade moves to the fixed blade 52*a*, the continuous sheet A1 is cut. Note that, the movable blade is positioned at the retracted position, and thus not illustrated in the figure.

The guide portion 4, which is provided in the roll body accommodating chamber 20, guides the path on which the continuous sheet A1 is sent forth such that the drawing-out angle of the continuous sheet A1 from the roll body A is made acute. In a specific description, the guide portion 4 is constituted by, while disposed on the rear side with respect to the center reference line L, a round-bar-shaped member protruding from the side wall 24 of the main body portion 2, and holds from the front side a drawn-out portion A2 (portion between roll body A and processing portion 5) of the continuous sheet A1 drawn out of the rear side of the roll body A with respect to the center reference line L. Further, the guide portion 4 is movable between the first position (position illustrated in FIG. 1) at which the guide portion 4 holds the drawn-out portion A2 of the continuous sheet A1 from the front side and the second position (position illustrated in FIG. 2) at which the guide portion 4 is led out of the space between the drawn-out portion A2 and the roll body A. In a specific description, the guide portion 4 is rotatably provided along the virtual horizontal plane (virtual plane extending along the sliding direction of slider 60 described later, that is, along the fore-and-aft direction, and orthogonal to the inner surface of side wall 24), and is turnable, by the guide portion moving means 6, between the first position at which the guide portion 4 protrudes from the inner surface of the side wall 24 and the second position at which the guide portion 4 is disposed along the inner surface of the side wall 24.

Figure 3:
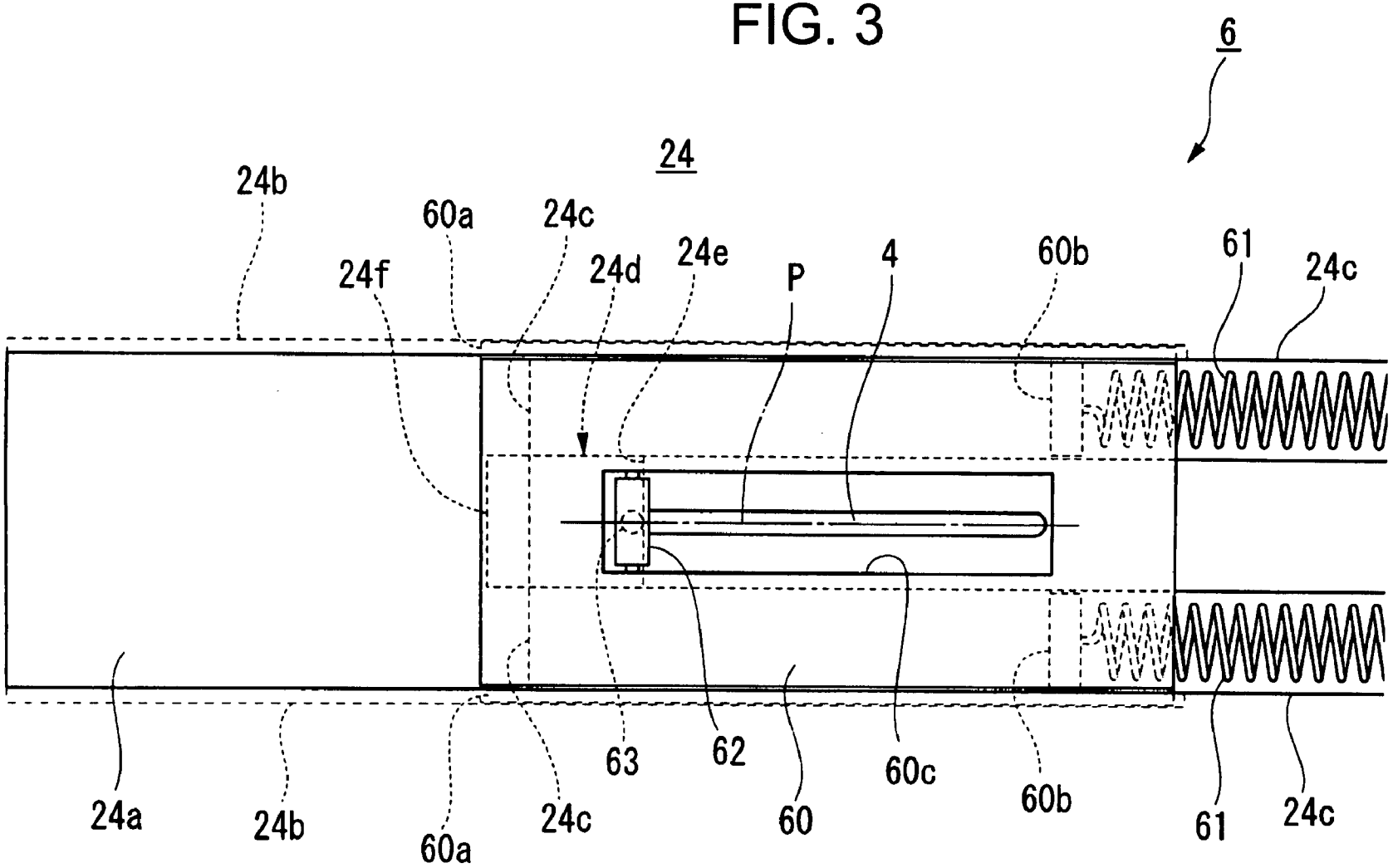
FIG. 3 is an enlarged view of a guide portion moving means for describing the embodiment of the present invention.
Figure 4A:
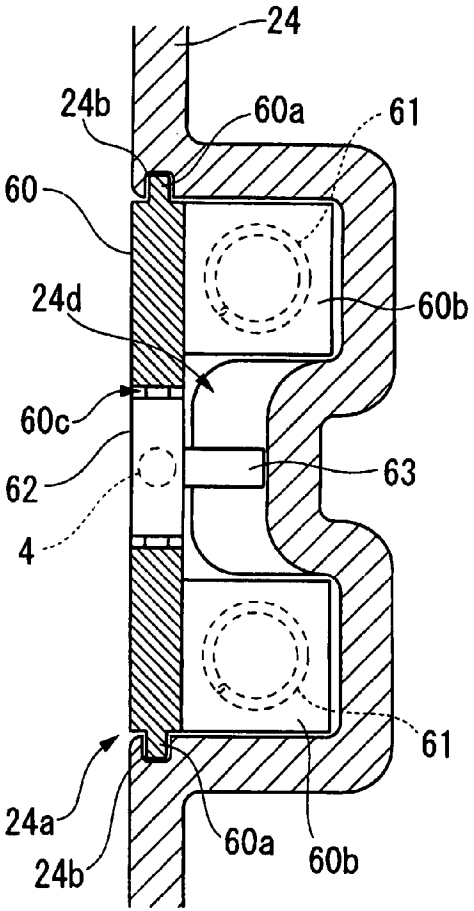
FIG. 4A-4C are longitudinal sectional views of the guide portion moving means for describing the embodiment of the present invention.
Figure 4B:
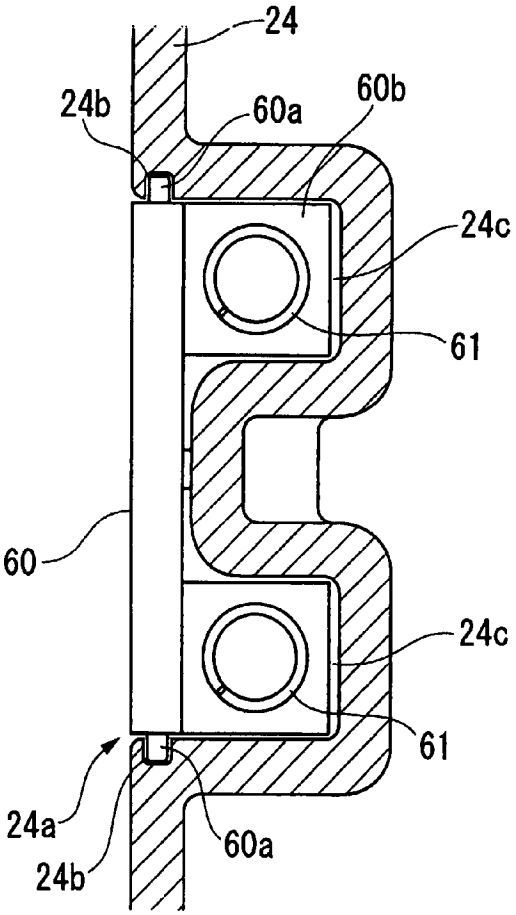
Figure 4C:
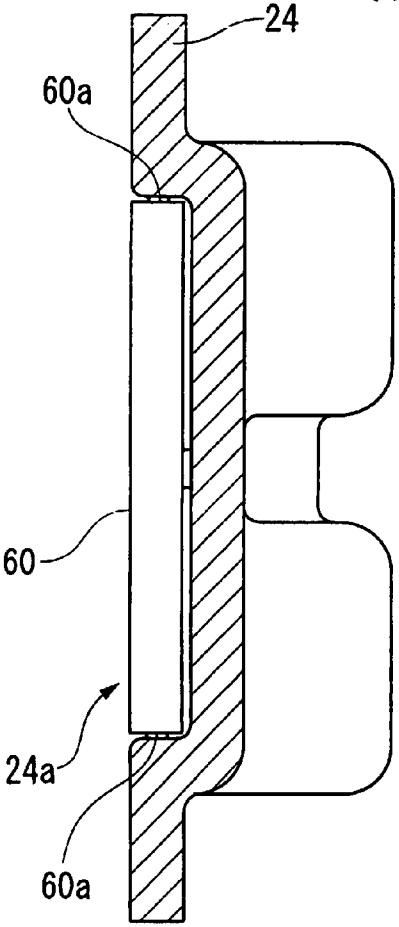

FIG. 3 is an enlarged view of the guide portion moving means 6. Further, FIG. 4A is a longitudinal sectional view taken along the line X-X illustrated in FIG. 2, FIG. 4B is a longitudinal sectional view taken along the line Y-Y illustrated in FIG. 2, and FIG. 4C is a longitudinal sectional view taken along the line Z-Z illustrated in FIG. 2. Further, FIG. 5A is a horizontal sectional view of the guide portion moving means 6 in the state where the door portion 3 is opened, and FIG. 5B is a horizontal sectional view of the guide portion moving means 6 in the state where the door portion 3 is closed.

Figure 5A:
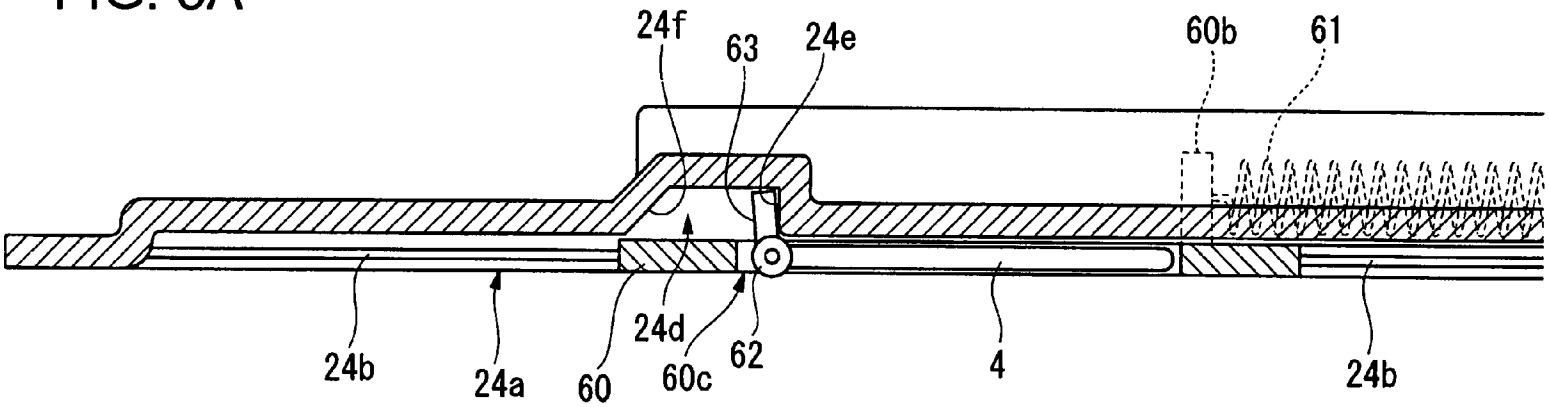
FIG. 5A-5B are horizontal sectional views of the guide portion moving means for describing the embodiment of the present invention.
Figure 5B:
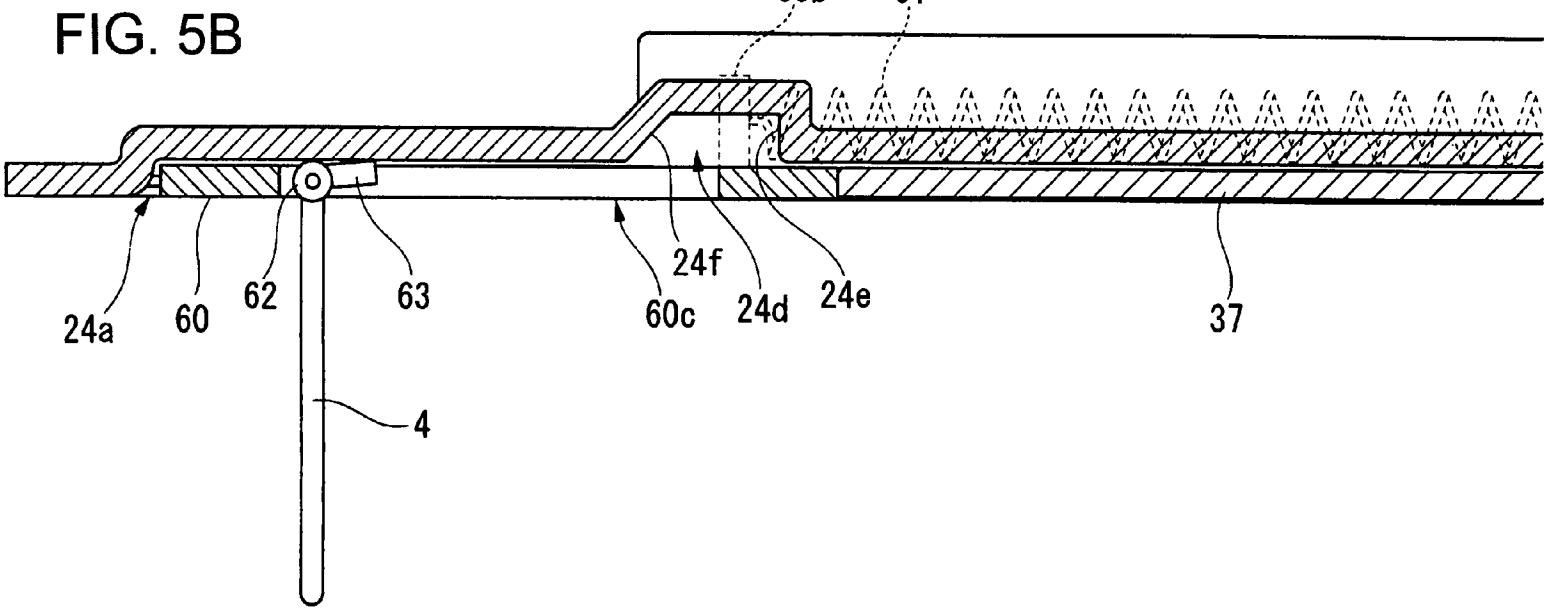

As illustrated in FIGS. 3 to 5, the guide portion moving means (guide portion acutator) 6, which is provided in the roll body accommodating chamber 20, is a means for moving the guide portion 4 between the first position illustrated in FIG. 5B and the second position illustrated in FIG. 5A. The guide portion moving means 6 is activated in conjunction with the opening operation and the closing operation of the door portion 3. Specifically, by the guide portion moving means 6, the guide portion 4 is moved to the second position in conjunction with the opening operation of the door portion 3; further, the guide portion 4 is moved to the first position in conjunction with the closing operation of the door portion 3.

In a detailed description, the guide portion moving means 6 includes a slider 60 and coil springs 61 (corresponding to the biasing members of the present invention). The slider 60 slides while being pressed, in accordance with the closing operation of the door portion 3, by the pressing portion 37 provided to the door portion 3, and is slidably provided along the wall surface of the roll body accommodating chamber 20 opposite to the end surface of the roll body A, that is, along the inner surface of the side wall 24 of the main body portion 2. In a specific description, a slider concave groove 24*a* extending in the fore-and-fore direction is formed on the inner surface of the side wall 24, and the slider 60 is fit in the slider concave groove 24*a*. The front end of the slider concave groove 24*a* extends to the front end of the side wall 24. When the door portion 3 is opened, the slider concave groove 24*a* is opened toward the front of the main body portion 2, and when the door portion 3 is closed, the slider concave groove 24*a* is closed by the longitudinal plate portion 32.

Rail grooves 24*b* extending in the long axial direction thereof are respectively formed on the upper and lower surfaces of the slider concave groove 24*a*. Protruding portions 60*a* protruding on the respective vertical end surfaces are rockably fitted in the rail grooves 24*b*, respectively. With this structure, the slider 60 is slidable along the slider concave groove 24*a*.

Further, coil spring concave grooves 24*c* extending in the fore-and-aft direction are respectively formed on the vertical end portions of the bottom surface of the slider concave groove 24*a*. Coil springs 61 are accommodated in the inner side of the coil spring concave grooves 24*c*, respectively. The coil springs 61 are biasing members for biasing the slider 60 slid by the pressing portion 37 in the direction in which the slider 60 is returned to the initial position, and extend in the sliding direction (fore-and-aft direction) of the slider 60.

The front ends of the coil spring concave grooves 24*c* are on the rear side with respect to the front end of the side wall 24, and are closed. Further, wall portions 60*b* disposed in the coil spring concave grooves 24*c* protrude on the rear surface of the slider 60 (surface opposite to the surface directed to the inner side of roll body accommodating chamber 20). The coil springs 61 are interposed between the wall portions 60*b* and the front end surfaces of the coil spring concave grooves 24*c*. The rear end surfaces of the coil springs 61 are attached to the wall portions 60*b*, and the front end surfaces of the coil springs 61 are attached to the front ends of the coil spring concave grooves 24*c*.

Further, in the middle portion of the slider concave groove 24*a* (between vertical coil spring concave grooves 24*c*), there is formed a concave-groove-shaped hole portion 24*d* extending in the fore-and-aft direction. The end surface (front end surface 24*e*) of the hole portion 24*d* on the side of the roll body inlet 21 (front side) is vertically formed with respect to the inner surface of the side wall 24. Meanwhile, the end surface (rear end surface 24*f*) on the opposite side (rear side) to the side of the hole portion 24*d* of the roll body inlet 21 forms an inclined surface as the depth of the hole portion 24*d* gradually decreases along with the inclination to the rear side.

An elongated hole 60*c* capable of accommodating the guide portion 4 while extending in the sliding direction is formed at the center portion of the slider 60. A rotational axis portion 62 extending in the vertical direction is provided at the rear end portion of the elongated hole 60*c*. From the rotational axis portion 62, the guide portion 4 protrudes while extending in the horizontal direction, and a pin-shaped engaging portion 63 protrudes while extending in the direction in which the engaging portion 63 intersects with a center axis line P of the guide portion 4. The engaging portion 63 is allowed to be inserted into the hole portion 24*d*, and extends in the direction substantially orthogonal to the guide portion 4.

The guide portion 4 is biased by the elastic member (not shown) such as a torsion spring such that the guide portion 4 is disposed at the position (position illustrated in FIG. 5A) so as to be accommodated in the elongated hole 60*c*.

Note that, there is adopted a structure in which the guide portion moving means 6 described above is provided to side wall 24 on each of both the sides the main body portion 2, and the guide portion 4 protrudes from the side wall 24 on each of both the sides.

Next, the operation of the continuous sheet processing apparatus 1 having the above-mentioned structure.

First, in the continuous sheet processing apparatus 1, when the door portion 3 is closed, the pressing portion 37 is inserted into the slider concave groove 24*a* as illustrated in FIG. 1. The front end surface of the pressing portion 37 presses the front end surface of the slider 60, to thereby enter the state where the slider 60 is pressed into the rear end portion of the slider concave groove 24*a*. In this case, as illustrated in FIG. 5B, the engaging portion 63 is held in a sliding contact with the bottom surface of the slider concave groove 24*a*, and the guide portion 4 protrudes from the inner surface of the side wall 24 to the inner side of the roll body inlet 21 and extends in a direction parallel to the center axis line O of the roll body A (FIG. 1).

Next, in replacing the roll body A, first, the door portion 3 is opened so as to open the roll body inlet 21. When the door portion 3 is opened, the pressing portion 37 moves forward together with the door portion 3 so as to be drawn out through the front end of the slider concave groove 24*a*. As a result, the pressing force by the pressing portion 37 to the slider 60 is cancelled. When the pressing force to the slider 60 is cancelled as described above, the slider 60 is slid forward along the slider concave groove 24*a* while being biased by the coil springs 61. Then, when the engaging portion 63 moves to the hole portion 24*d*, the engaging portion 63 is disengaged from the bottom surface of the slider concave groove 24*a*. By the elastic force by the elastic member (not shown), the engaging portion 63 and the guide portion 4 rotate about the rotational axis portion 62. As a result, the engaging portion 63 is inserted into the hole portion 24*d*, and the guide portion 4 is accommodated in the elongated hole 60*c* of the slider 60 so as to be disposed along the inner surface of the side wall 24 at the second position at which the guide portion 4 is led out of the space between the drawn-out portion A2 and the roll body A. Then, when the slider 60 slides farther forward, as illustrated in FIG. 5A, the engaging portion 63 comes into contact with the front end surface 24*e* of the hole portion 24*d*, whereby the slider 60 stops sliding at a predetermined position. In this manner, simultaneously with the opening operation of the door portion 3, the guide portion 4 moves to be disposed at the second position and extends transverse to the center axis line O of the roll body A (FIG. 2), thereby being brought out of the space between the roll body A and the drawn-out portion A2 of the continuous sheet A1.

Further, when the door portion 3 is opened, the inclined plate portion 31 of the door portion 3 becomes horizontal, so the bottom plate portion 30 and the longitudinal plate portion 32 are disposed in a configuration of an inverted shape of ^ (substantially v-shaped configuration). In this case, the roll body A in the roll body accommodating chamber 20 rolls in accordance with the rocking (opening operation) of the door portion 3, thereby being placed on the inclined plate portion 31.

Next, as illustrated in FIG. 2, when the roll body A on the inclined plate portion 31 is removed, a new roll body A is thrown-in via the roll body inlet 21 so as to be placed on the inclined plate portion 31. In this case, the new roll body A is supported by the upper surface (inclined surface 34*b*) of the pedestal 34B on the front side and the upper surface (inclined surface 33*a*) of the temporal pedestal 33. Further, the new roll body A is disposed while directed such that the continuous sheet A1 is drawn out of the upper portion of the roll body A, and the continuous sheet A1 drawn out of the roll body A is placed on the platen roller 51.

Next, the door portion 3 is closed so as to close the roll body inlet 21. In this case, the roll body A on the inclined plate portion 31 rolls together with the rocking (closing operation) of the door portion 3, and is placed on the bottom plate portion 30 to be supported by the upper surfaces of the pair of pedestals 34A and 34B (inclined surface 34*a* and 34*b*). Further, the continuous sheet A1 placed on the platen roller 51 is caught between the platen roller 51 and the processing head 50.

Further, when the door portion 3 is closed, the pressing portion 37 moves together with the door portion 3 in a circular arc manner, and is inserted into the slider concave groove 24*a* via the front end of the slider concave groove 24*a*. Further, in accordance with the closing operation of the door portion 3, the pressing portion 37 moves rearward along the slider concave groove 24*a*. As a result, the front end surface of the pressing portion 37 presses the front end surface of the slider 60, so the slider 60 slides rearward along the slider concave groove 24*a*. Then, when the engaging portion 63 moves to a rear end surface 24*f* of the hole portion 24*d*, the front end portion of the engaging portion 63 slides on the inclined rear end surface 24*f*. As a result, the guide portion 4 and the engaging portion 63 rotate about the rotational axis portion 62. Further, since the engaging portion 63 slides on the inclined surface (rear end surface 24*f*) so as to turn the guide portion 4, the impact (load) generated in disengaging the engaging portion 63 from the hole portion 24*d* is alleviated, so the guide portion 4 is smoothly turned. Subsequently, when the slider 60 farther retracts, and the engaging portion 63 traverses the rear end surface 24*f* of the hole portion 24*d*, the engaging portion 63 slides on the bottom surface of the slider concave groove 24*a* as illustrated in FIG. 5B, so the guide portion 4 protrudes from the inner surface of the side wall 24 to the inner side of the roll body accommodating chamber 20. As a result, as illustrated in FIG. 1, the drawn-out portion A2 of the continuous sheet A1 is held by the guide portion 4 from the front side, so the drawn-out portion A2 enters a state of being bent in a dogleg shape, whereby the drawing-out angle of the continuous sheet A1 is made acute. As described above, simultaneously with the closing operation of the door portion 3, the guide portion 4 is moved so as to be disposed at the first position, so the drawn-out portion A2 of the continuous sheet A1 is held from the other side.

In the continuous sheet processing apparatus 1 having the above-mentioned structure, since the drawn-out portion A2 of the continuous sheet A1 is held by the guide portion 4, the drawing-out angle of the continuous sheet A1 is made acute. Thus, it is possible to prevent the lifting-up of the roll body A at the time of drawing-out of the continuous sheet A1.

Further, since the guide portion 4 is brought out, by the guide portion moving means 6, of the path on which the continuous sheet A1 is sent forth, the guide portion does not present as an obstruct in throwing the roll body A into the roll body accommodating chamber 20. As a result, the roll body A can be easily thrown-in, which leads to an increase in operability.

Further, the guide portion 4 and the guide portion moving means 6 are provided in the roll body accommodating chamber 20, and positioned such that a user cannot easily touch the guide portion 4 and the guide portion moving means 6. Thus, the defects are less liable to occur in the guide portion 4 and the guide portion moving means 6, so the drawing-out angle of the continuous sheet A1 can be reliably made acute.

In particular, in the continuous sheet processing apparatus 1 described above, the guide portion moving means 6 is provided so as to be activated in conjunction with the opening operation and the closing operation of the door portion 3. Thus, the replacing operation of the roll body A is facilitated as follows: (1) opening the door portion 3, (2) throwing-in or exchanging the roll body A, and (3) closing the door portion 3, thereby being extremely user-friendly.

Further, in the continuous sheet processing apparatus 1 described above, since the pressing portion 37 provided to the door portion 3 presses the slider 60 sliding along the wall surface of the roll body accommodating chamber 20, the guide portion 4 protrudes from the guide portion moving means 6, thereby enabling reliable taking-out and putting-in of the guide portion 4 with the simple structure.

Further, in the continuous sheet processing apparatus 1 described above, since the rear end surface 24*f* of the hole portion 24*d* forms an inclined surface, the impact generated in the protrusion of the guide portion 4 is alleviated, thereby being more user-friendly.

Further, in the continuous sheet processing apparatus 1 described above, the front end surface 24*e* of the hole portion 24*d* functions as a retraction stopper of the slider 60, and the slider 60 stops retracting while the engaging portion 63 comes into contact with the front end surface 24*e* of the hole portion 24*d*. Thus, it is possible to stop the slider 60 at a predetermined position, thereby preventing the slider 60 from letting out of the slider concave groove 24*a* owing to excessive retraction thereof.

As described above, the embodiment of the continuous sheet processing apparatus according to the present invention has been described, the present invention is not limited to the above-mentioned embodiment, but can be appropriately modified without departing from the spirit thereof.

For example, in the above-mentioned embodiment, the processing portion 5 and the door portion 3 are disposed on the front surface side, and the guide portion 4 is disposed on the rear surface side. However, the positions of the door portion 3, the guide portion 4, and the processing portion 5 can be appropriately modified without departing from the spirit of the present invention. For example, the processing portion 5 may be positioned on the upper surface.

Further, while in the above-mentioned embodiment, the guide portion 4 is constituted by a round-bar-shaped member, the present invention is not limited by the shape of the guide portion. For example, the plate-shaped guide portion may be provided.

Further, in the above-mentioned embodiment, the slider 60 and the coil springs 61 are provided, and the guide portion moving means 6 is provided so as to be activated in conjunction with the opening operation and the closing operation of the door portion 3. However, the guide portion moving means can be appropriately modified. For example, the guide portion moving means may have the following structure in which: when the door portion 3 is closed, the switch is pressed so that the guide portion 4 protrudes, and when the door portion 3 is opened, the switch is turned off so that the guide portion 4 is accommodated; alternatively, when the user operates the switches and the like on the operation panel (not shown) and the like, the guide portion is taken-out and put-in without in conjunction with the opening operation and the closing operation of the door portion 3.

Further, in the above-mentioned embodiment, the rear end surface 24*f* of the hole portion 24*d* forms an inclined surface. However, in the present invention, it is possible to form the rear end surface 24*f* of the hole portion 24*d* to be a surface vertical with respect to the inner surface of the side wall 24.

Further, in the above-mentioned embodiment, there is employed a structure in which the slider 60 stops retracting while the engaging portion 63 comes into contact with the front end surface 24*e* of the hole portion 24*d*. However, there can be employed a structure in which the engaging portion 63 does not come into contact, when the slider 60 retracts, with the front end surface 24*e* of the hole portion 24*d*. For example, it is possible to form the stopper in the rail groove 24*b*.

In addition, without departing from the gist of the present invention, it is possible to appropriately replace the components of the above-mentioned embodiment with the well-known components. Further, the above-mentioned modifications may be appropriately combined with each other.

What is claimed is:

1. A continuous sheet processing apparatus comprising:

a main body portion having a roll body accommodating chamber for accommodating a roll body formed of a wound continuous sheet, and a roll body inlet through which the roll body is inserted into the roll body accommodating chamber;

a door portion for opening and closing the roll body inlet;

a guide portion that is disposed on one side with respect to a center reference line orthogonal to a center axis line of the roll body accommodated in the roll body accommodating chamber, and that holds from another side a drawn-out portion of the continuous sheet drawn out of a portion on the one side with respect to the center reference line of the roll body;

a processing portion disposed on the another side with respect to the center reference line for processing the continuous sheet sent forth via the guide portion; and guide portion moving means for moving the guide between a first position, in conjunction with a closing operation of the door portion, at which the guide portion holds the drawn-out portion from the other side and a second position, in conjunction with an opening operation of the door portion, at which the guide portion is led out of a space between the drawn-out portion and the roll body, the guide portion moving means comprising a slider which is slidably provided along a wall surface of the roll body accommodating chamber facing an end surface of the roll body, and which slides while pressed by a pressing portion provided to the door portion in conjunction with the closing operation of the door portion; and a biasing member for biasing the slider slid by the pressing portion in a direction in which the slider is returned to an initial position; wherein the guide portion is rotatably provided to the slider along a virtual plane orthogonal to the wall surface while extending in a sliding direction of the slider; and a rotational axis portion of the guide portion has an engaging portion which protrudes therefrom and extends in a direction in which the engaging portion intersects with a center axis line of the guide portion such that in a state before the pressing portion allows the slider to slide, the engaging portion is inserted into a hole portion formed in the wall surface so as to dispose the guide portion at the second position along the wall surface, and in a state after the pressing portion allows the slider to slide, the engaging portion is disengaged from the hole portion so as to dispose the guide portion at the first position while the guide portion protrudes from the wall side surface.

2. A continuous sheet processing apparatus according to claim 1; wherein an end surface of the hole portion on an opposite side of the roll body inlet side forms an inclined surface so that a depth of the hole portion gradually decreases toward the opposite side.

3. A continuous sheet processing apparatus according to claim 2; wherein in a state before the pressing portion allows the slider to slide, the engaging portion is fitted to the end surface of the hole portion on the roll body inlet side.

4. A continuous sheet processing apparatus according to claim 1; wherein in a state before the pressing portion allows the slider to slide, the engaging portion is fitted to the end surface of the hole portion on the roll body inlet side.

5. A continuous sheet processing apparatus comprising:

a main body portion having an accommodating chamber that accommodates a roll formed of a wound continuous sheet and an inlet through which the roll is introduced into the accommodation chamber;

a door portion movable to open and closed positions for opening and closing the inlet;

a processing portion that processes the continuos sheet drawn out from the roll;

a guide portion movable between a first position in which the guide portion extends parallel to the center axis of the roll and guides the path of the drawn-out continuous sheet so that the drawing-out angle thereof is an acute angle, and a second position in which the guide portion extends transverse to the center axis of the roll; and a guide portion actuator that moves the guide portion to the first position in conjunction with movement of the door portion to the closed position and moves the guide portion to the second position in conjunction with movement of the door portion to the open position.

6. A continuous sheet processing apparatus according to claim 5; wherein the guide portion is pivotally mounted on the guide portion actuator.

7. A continuous sheet processing apparatus according to claim 5; wherein the guide portion actuator has a slider slidably disposed on a wall of the accommodating chamber, the slider having an opening which receives therein the guide portion when the guide portion is in the second position.

8. A continuous sheet processing apparatus according to claim 7; wherein the guide portion is pivotally mounted to the slider.

9. A continuous sheet processing apparatus according to claim 5; wherein the guide portion actuator comprises a slider slidably disposed along a wall of the accommodating chamber, biasing means for biasing the slider in one direction to one position when the door portion is in the open position to place the guide portion in the second position, and a pressing portion that is connected to the door portion for movement therewith and that presses the slider in the opposite direction against the biasing action of the biasing means during closing of the door portion to the closed position to place the guide portion in the first position.

10. A continuous sheet processing apparatus according to claim 9; wherein the guide portion is pivotally mounted to the slider.

11. A continuous sheet processing apparatus according to claim 9; wherein the guide portion is pivotally mounted on the slider and has an engaging portion in slidable engagement with the wall of the accommodating chamber to pivot the guide portion from the second position to the first position during movement of the slider in the opposite direction.

12. A continuous sheet processing apparatus according to claim 11; wherein the slider has an opening that receives the guide portion when the guide portion is in the second position.

13. A continuous sheet processing apparatus according to claim 5; including two guide portions and two guide portion actuators disposed on opposite sides of the accommodating chamber.

* * * * *